US008870623B2

(12) United States Patent
Ferreyra et al.

(10) Patent No.: US 8,870,623 B2
(45) Date of Patent: Oct. 28, 2014

(54) TOY TRACK SET

(75) Inventors: Gustavo Ferreyra, El Segundo, CA (US); Kurnia Alim, Bell Gardens, CA (US); Alex Au, Hong Kong (CN); Stacy O'Connor, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 163 days.

(21) Appl. No.: 13/455,306

(22) Filed: Apr. 25, 2012

(65) Prior Publication Data

US 2013/0109271 A1 May 2, 2013

Related U.S. Application Data

(60) Provisional application No. 61/480,846, filed on Apr. 29, 2011.

(51) Int. Cl.
*A63H 29/00* (2006.01)

(52) U.S. Cl.
USPC ..... 446/429

(58) Field of Classification Search
USPC ..... 446/429
See application file for complete search history.

(56) References Cited

U.S. PATENT DOCUMENTS 1,551,002 A * 8/1925 Beck ..... 104/79
1,715,891 A * 6/1929 Beck ..... 104/79
3,209,491 A 10/1965 Roeper
3,359,920 A 12/1967 Iammatteo
3,713,654 A 1/1973 Goldfarb
3,858,875 A 1/1975 Nemeth et al.
4,094,089 A 6/1978 Sano
4,185,409 A 1/1980 Cheng
4,249,733 A 2/1981 Eddins et al.
4,355,807 A 10/1982 Prehodka
4,383,688 A 5/1983 Prehodka
4,423,871 A 1/1984 Mucaro
4,513,966 A 4/1985 Mucaro et al.
4,513,967 A 4/1985 Halford et al.
4,519,789 A 5/1985 Halford et al.
4,715,843 A 12/1987 Ostendorff et al.
5,174,569 A 12/1992 Ngai
5,299,969 A 4/1994 Zaruba
5,542,668 A 8/1996 Casale et al.
5,586,923 A * 12/1996 Hippely et al. ..... 446/14
5,643,040 A * 7/1997 Hippely et al. ..... 446/429
6,000,992 A 12/1999 Lambert
6,358,112 B1 3/2002 Lambert et al.
7,549,906 B2 6/2009 Bedford et al.

(Continued)

FOREIGN PATENT DOCUMENTS

WO 9201497 2/1992

*Primary Examiner* — Alvin Hunter
*Assistant Examiner* — Dolores Collins
(74) *Attorney, Agent, or Firm* — Cantor Colburn LLP

(57) ABSTRACT

A toy track set is provided. The toy track set having: a vehicle path defined by a track and a gap disposed between a first end and a second end of the track; a catapult mechanism disposed within the vehicle path adjacent the first end, the catapult mechanism comprising: a platform member and a switch operably coupled to move the platform member from the second position to the first position. A catapult member having a first arm and a second arm rotationally coupled to the track, the first arm movable between a third position and a fourth position. A release mechanism is disposed adjacent the first end, the release mechanism having a trigger operably coupled to retain the catapult member in the third position.

9 Claims, 18 Drawing Sheets

(56) References Cited

U.S. PATENT DOCUMENTS

| | | | | |
|---|---|---|---|---|
| 7,628,673 | B2 | 12/2009 | Bedford et al. | |
| 7,628,674 | B2 | 12/2009 | Nuttall et al. | |
| 7,682,218 | B2 | 3/2010 | Yu et al. | |
| 7,690,964 | B2 * | 4/2010 | Nuttall et al. | 446/444 |
| 7,794,301 | B2 * | 9/2010 | Ostendorff et al. | 446/429 |
| 7,819,720 | B2 * | 10/2010 | Nuttall et al. | 446/444 |
| 7,857,679 | B2 * | 12/2010 | O'Connor et al. | 446/429 |
| 7,892,068 | B2 | 2/2011 | Nuttall et al. | |
| 7,934,970 | B2 * | 5/2011 | O'Connor | 446/6 |
| 8,006,943 | B2 * | 8/2011 | O'Connor | 246/415 A |
| 8,176,852 | B2 * | 5/2012 | O'Connor | 104/53 |
| 8,256,721 | B2 * | 9/2012 | O'Connor et al. | 246/415 A |
| 8,322,660 | B2 * | 12/2012 | O'Connor | 246/415 A |
| 8,323,069 | B2 * | 12/2012 | Nuttall et al. | 446/444 |
| 8,382,553 | B2 * | 2/2013 | O'Connor | 446/444 |
| 8,403,721 | B2 * | 3/2013 | Derman | 446/2 |
| 8,574,023 | B2 * | 11/2013 | Schmid et al. | 446/444 |
| 2005/0191940 | A1 * | 9/2005 | Sheltman et al. | 446/437 |
| 2005/0287916 | A1 * | 12/2005 | Sheltman et al. | 446/444 |
| 2005/0287918 | A1 * | 12/2005 | Sheltman et al. | 446/444 |
| 2007/0293122 | A1 | 12/2007 | O'Connor et al. | |
| 2008/0020675 | A1 | 1/2008 | Ostendorff | |
| 2008/0070472 | A1 | 3/2008 | Campbell | |
| 2009/0130946 | A1 | 5/2009 | Fink et al. | |
| 2009/0176545 | A1 | 7/2009 | Civettini et al. | |
| 2010/0041305 | A1 | 2/2010 | O'Connor | |
| 2010/0273394 | A1 * | 10/2010 | O'Connor et al. | 446/429 |
| 2010/0291833 | A1 * | 11/2010 | O'Connor et al. | 446/429 |
| 2010/0304639 | A1 | 12/2010 | Payne et al. | |
| 2010/0330868 | A1 | 12/2010 | Payne | |
| 2011/0092132 | A1 * | 4/2011 | O'Connor et al. | 446/429 |
| 2011/0124265 | A1 * | 5/2011 | O'Connor et al. | 446/429 |
| 2013/0078887 | A1 * | 3/2013 | Payne | 446/429 |

* cited by examiner

TOY TRACK SET

CROSS REFERENCE TO RELATED APPLICATIONS

This application claims the benefit of U.S. Provisional Patent Application Ser. No. 61/480,846, filed Apr. 29, 2012, the contents of which are incorporated herein by reference thereto.

BACKGROUND

The subject matter disclosed herein relates to toys, and in particular to a track set for toy vehicles to travel on.

Toy vehicle track sets have been popular for many years and generally include one or more track sections arranged to form a path around which one or more toy vehicles can travel. Toy vehicles, which may be used on such track sets, may be either self-powered vehicles or may receive power from an external source.

Accordingly, it is desirable to provide a toy track set with features that provide unique paths for toy vehicles of the toy track to travel on.

It is further desirable to provide a toy track set having gap and a jumping arrangement to build skills in timing to allow the toy vehicle to traverse the gap.

SUMMARY

According to embodiment, a toy track set is provided, the toy track set having: a vehicle path defined by a track and a gap disposed between a first end and a second end of the track; a catapult mechanism disposed within the vehicle path adjacent the first end, the catapult mechanism having: a platform member movably coupled to the track, the platform member being movable between a first position being substantially level with the track and a second elevated position; a switch operably coupled to move the platform member from the second position to the first position; a catapult member having a first arm and a second arm rotationally coupled to the track, the first arm movable between a third position and a fourth position; and, a release mechanism disposed adjacent the first end, the release mechanism having a trigger operably coupled to retain the catapult member in the third position, wherein the release mechanism releases the catapult member in response to a toy vehicle contacting trigger.

In another embodiment, a toy track set is provided, the toy track set having: a first vehicle path defined by a track and a first gap disposed between a first end and a second end of the track; a second vehicle path arranged to selectively contact the track, the second vehicle path having: a first ramp adjacent a play surface; a second ramp rotatably disposed between the first ramp and the track and movable between a first position and a second position, the second ramp having a first end and a second end, wherein the first end is disposed to receive a toy vehicle from the first ramp and the second end is adjacent the track when the second ramp is in the first position.

In still another embodiment a toy track set is provided, the toy track set having: a vehicle path defined by a track and a gap disposed between a first end and a second end of the track; a movable obstacle at least partially disposed within the gap, the movable obstacle having: a base; a pendulum arm coupled the base; a transverse arm operably coupled to the pendulum arm, the transverse arm being movable between a first position and second position; and at least one obstacle device coupled to an end of the transverse arm, the at least one obstacle device being positioned in the vehicle path within the gap as the transverse arm moves from the first position to the second position.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
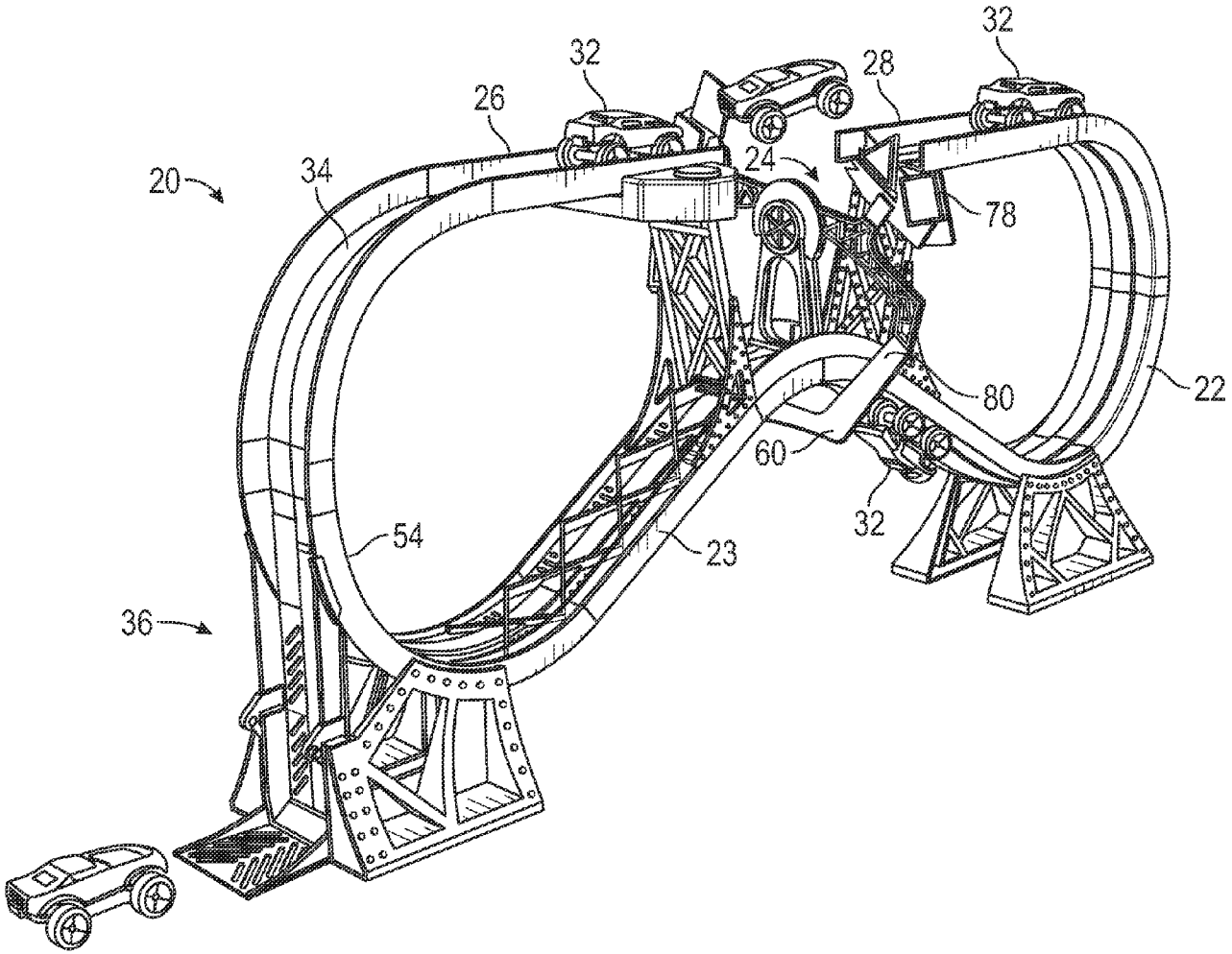
FIG. 1 is a perspective view of a toy track set in accordance with an embodiment of the invention.
Figure 2:
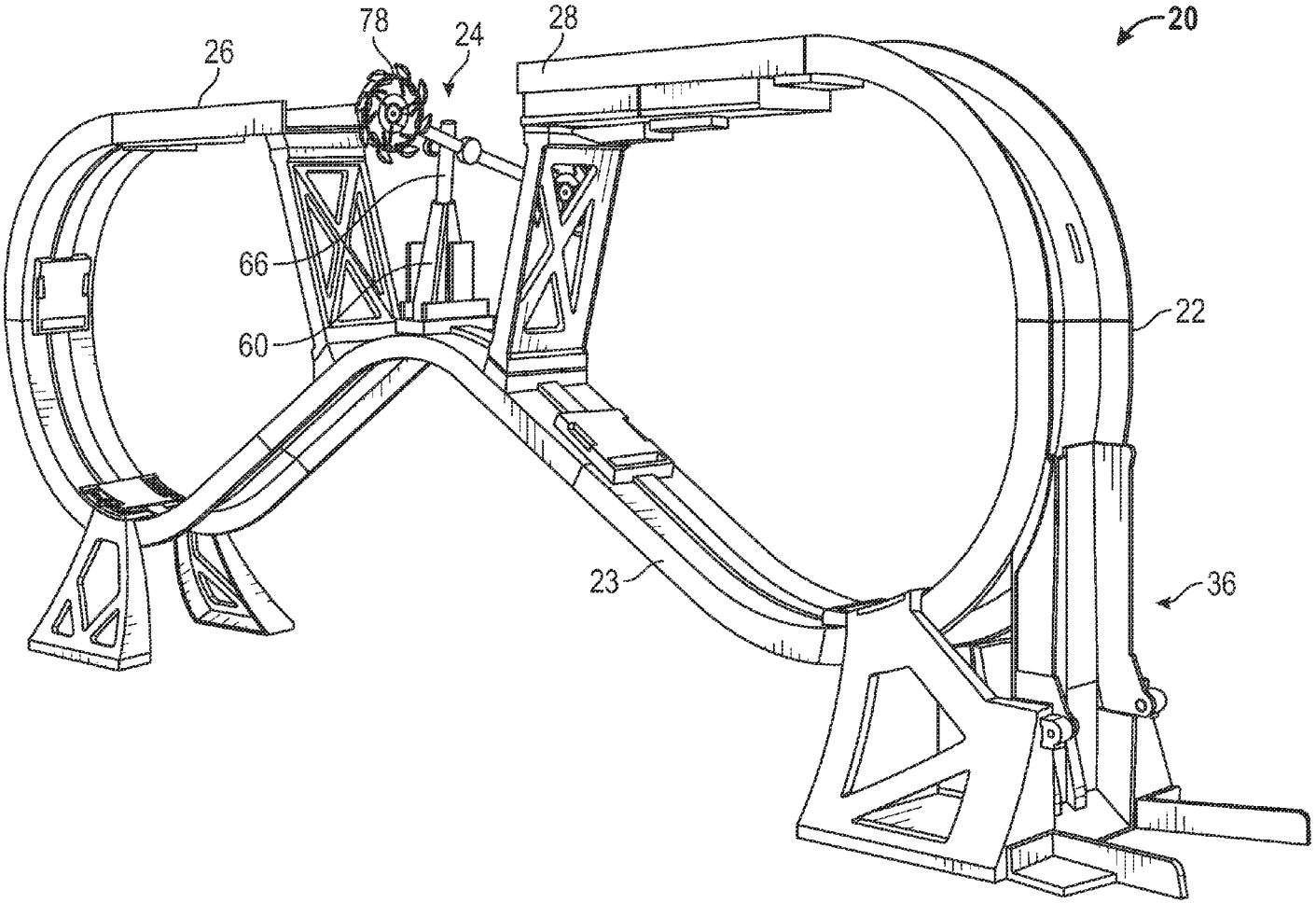
FIG. 2 is another perspective view of the toy track set of FIG. 1.
Figure 3:
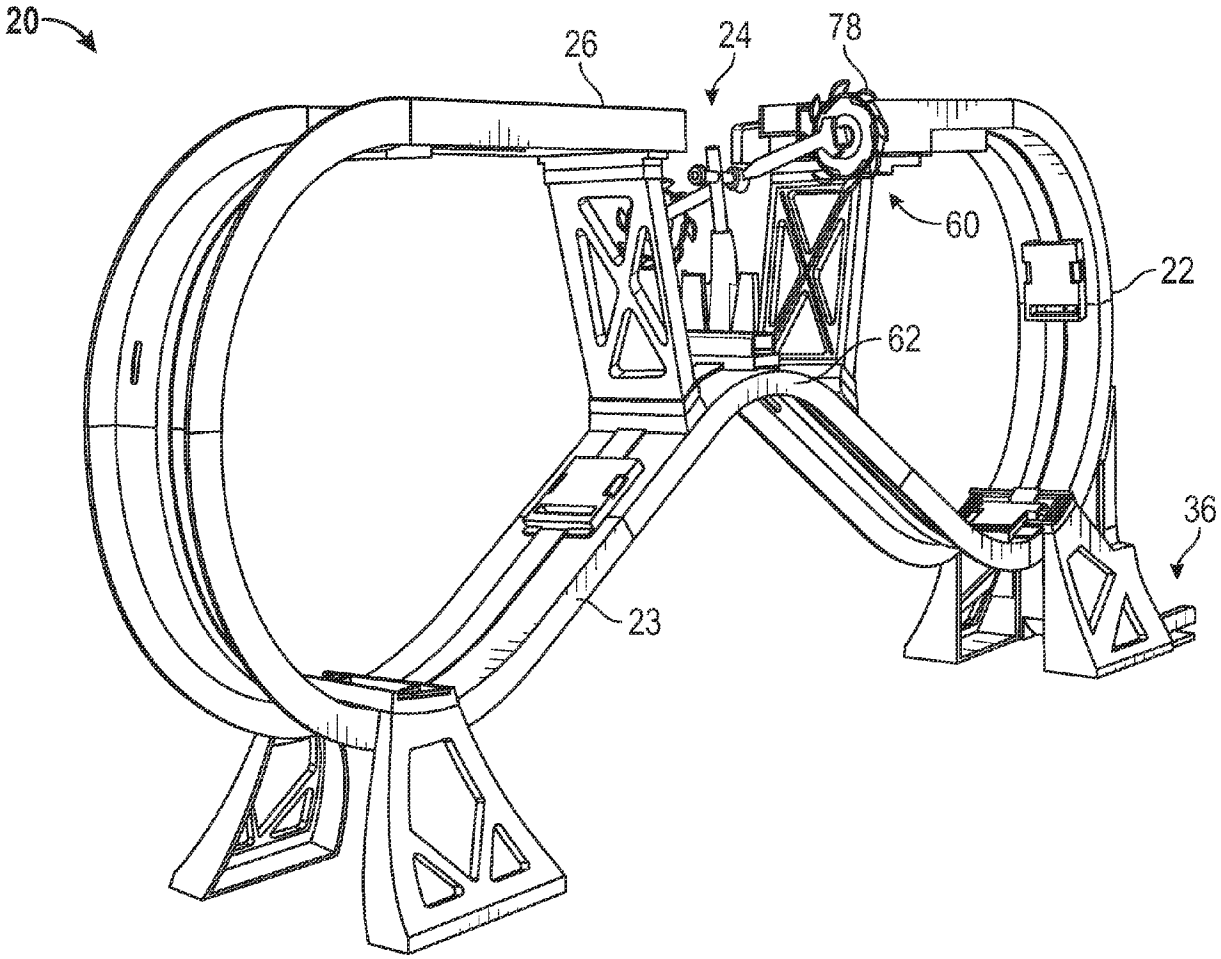
FIG. 3 is another perspective view of the toy track set of FIG. 1.
Figure 4:
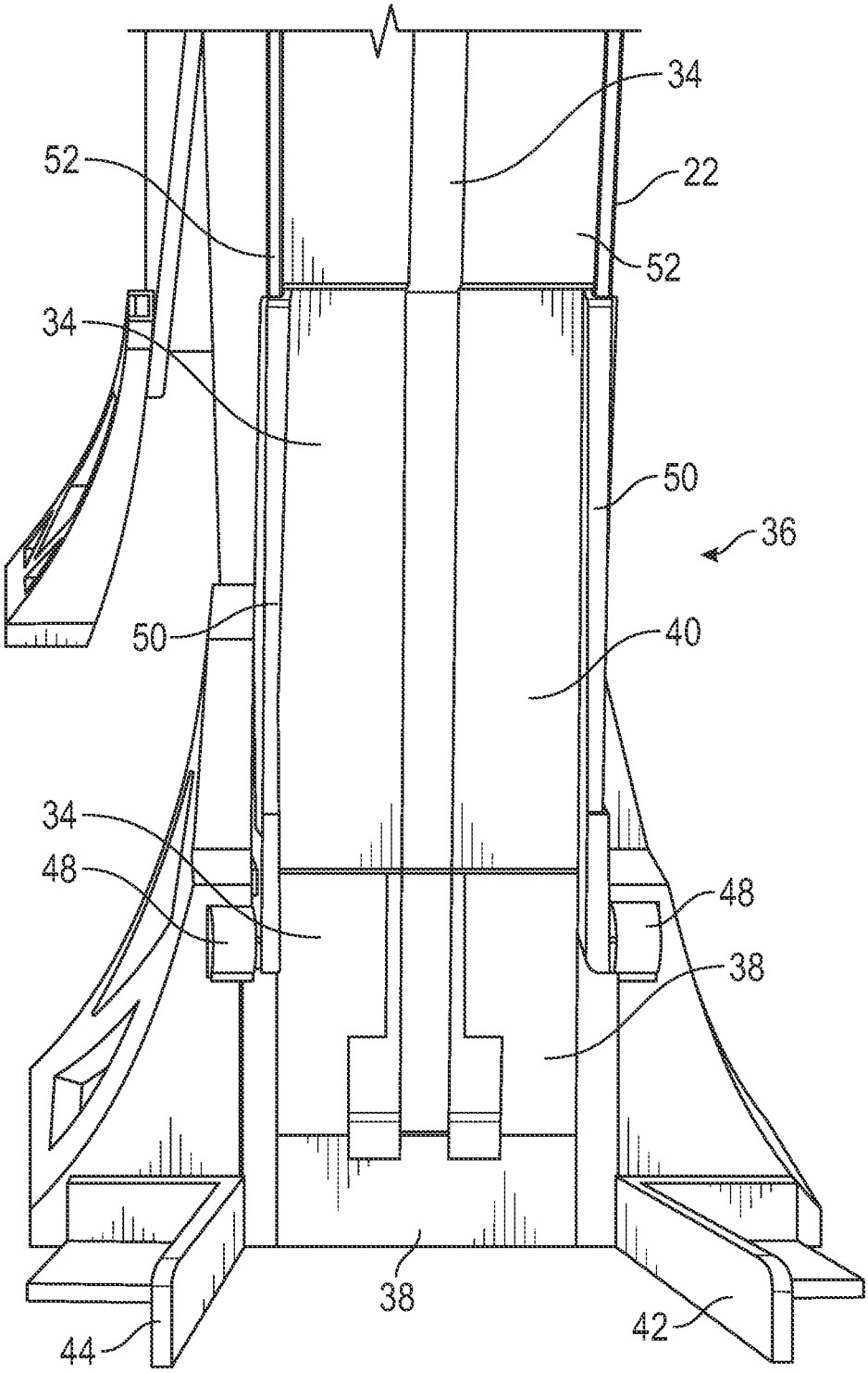
FIG. 4 is a perspective view of an entrance portion of the toy track set of FIG. 1.
Figure 5:
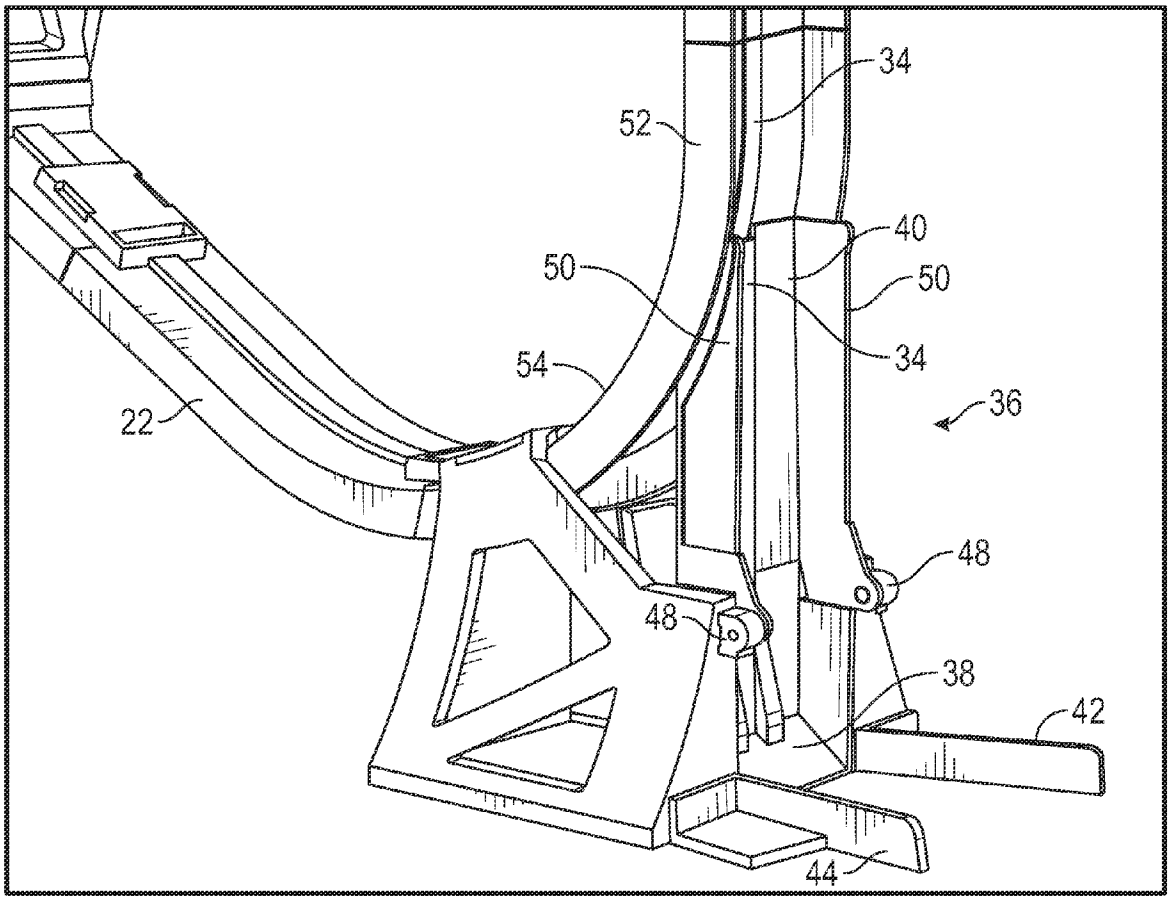
FIG. 5 is another perspective view of the entrance portion of the toy track set of FIG. 1.

The detailed description explains embodiments of the invention, together with advantages and features, by way of example with reference to the drawings.

DETAILED DESCRIPTION OF THE INVENTION

Reference is made to the following U.S. Pat. Nos. 7,628,673 and 7,549,906 the contents each of which is incorporated by reference in their entirety herein. Reference is also made to the following U.S. Patent Application Ser. No. 61/377,766 filed Aug. 27, 2010, Ser. No. 61/377,731 filed Aug. 27, 2010, Ser. No. 61/391,349 filed Oct. 8, 2010, and Ser. No. 61/418,618 filed Dec. 1, 2010 the contents each of which are incorporated herein by reference thereto.

As illustrated in the FIGS. a toy track set 20 is provided, the toy track set 20 having a vehicle path defined by a track 22 and a gap 24 disposed between a pair of ends 26, 28 of the track 22.

The toy track set 20 further comprises a catapult mechanism 30 or catapult assembly configured to allow a toy vehicle 32 to traverse the gap 24 and travel to the end 28. In one embodiment, the toy vehicle 32 is self-propelled. Motion of the toy vehicle may occur by a variety of propulsion means. Toy vehicle propulsion means can include storing energy for propulsion in the vehicle 32, drawing energy for propulsion from an external source, or manually propelling the vehicle 32. Storing energy in a toy vehicle may occur by electrically or mechanically storing energy. For example, energy can be stored electrically by charging a battery on a toy vehicle or energy may be stored mechanically by spinning an inertial flywheel. A toy vehicle may have different speeds and may change speeds selectively while moving on a toy play set.

In one embodiment, a ferromagnetic material 34 is disposed in the track 22 or within individual track segments. The toy vehicle 32 may have at least one magnet disposed in the toy vehicle 32 such that the toy vehicle 32 may travel on the track 22 in anyone of an inverted or vertical manner. In other words, the magnetic attraction of the magnet to the ferromagnetic material 34 allows the toy vehicle 32 to travel along the track 22 in an inverted, vertical or other configuration. The toy track 20 may form a continuous loop where a portion 23 is inverted. In one embodiment, the inverted portion 23 is translucent.

The toy track set 20 may include multiple vehicle paths and include an entrance portion 36. Referring to FIG. 1 and FIGS. 4-8 an entrance 36 is shown having a fixed ramp 38 arranged adjacent the play surface and a movable or pivoting ramp 40. The entrance 36 has a pair of arms 42, 44 that may be sized to receive a toy vehicle or an external track 46. In one embodiment, the arms 42, 44 assist in guiding the toy vehicle 32 onto the fixed ramp 38. Similar to the track 22, the fixed ramp 38 and pivoting ramp 40 may include a ferromagnetic material 34 that cooperates with a magnet in the toy vehicle 32 to retain the toy vehicle on the ramps 38, 40. The ramps 38, 40 are disposed to create a vehicle path onto the track 22.

Figure 6:
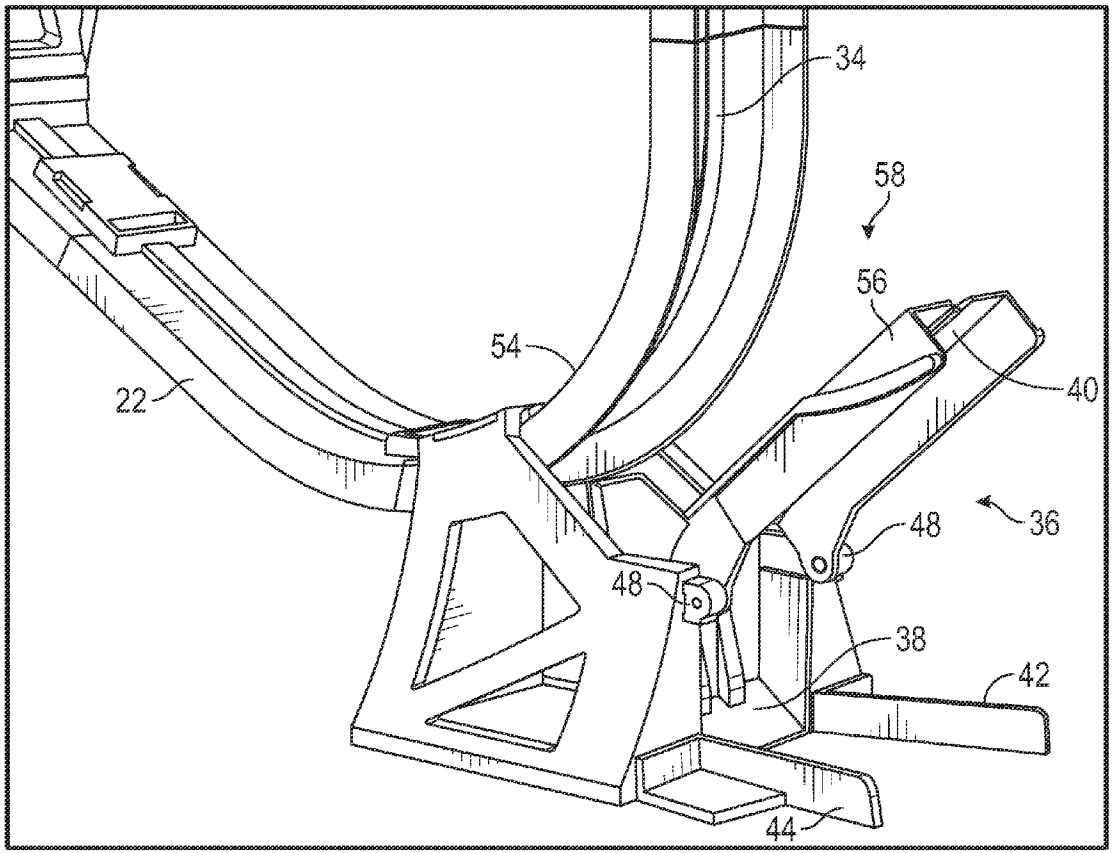
FIG. 6 is another perspective view of the entrance portion of the toy track set of FIG. 1.
Figure 7:
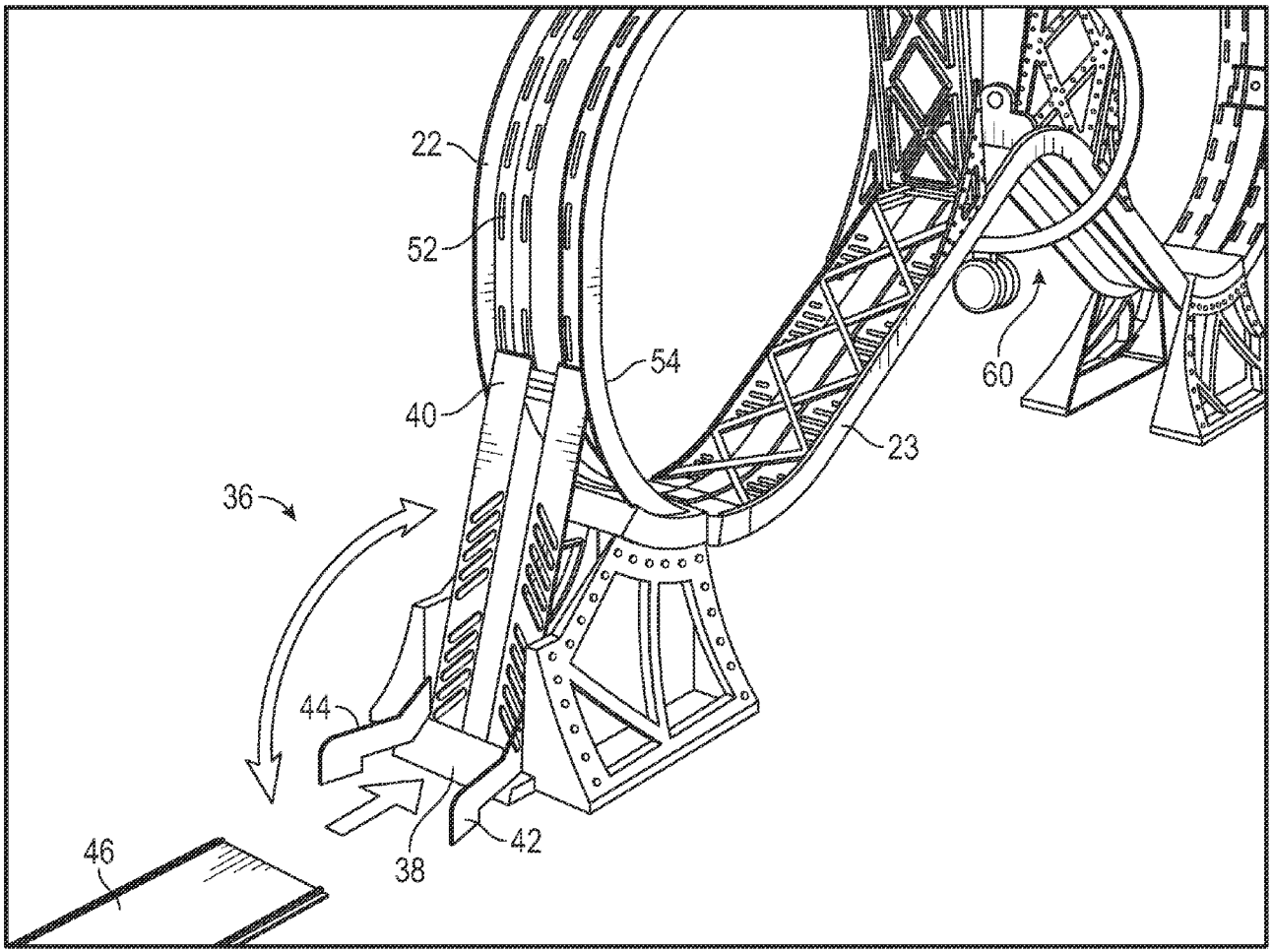
FIG. 7 is yet another perspective view of the entrance portion of the toy track set of FIG. 1.

In the exemplary embodiment, the pivoting ramp 40 is a coupled to the fixed ramp 38 by a pair of pivot members 48. The pivot members 48 may include a biasing spring (not shown) that urges the pivoting ramp 40 into contact with the track 22. The pivoting ramp 40 may include sidewalls 50 that engage walls 52 of track 22 to facilitate the transition of the vehicle 32 onto the track 22. The pivoting ramp 40 is movable between a first position (FIG. 5) wherein an end of pivoting ramp 40 is in contact with the ramp 22 and a second position (FIG. 6). During operation, the pivoting ramp 40 may be biased towards the first position. When a toy vehicle 32 travels in between the arms 42, 44, the vehicle 32 travels along the fixed ramp 38 allowing the magnet on the vehicle 32 to engage the ferromagnetic material 34. Since the attraction of the magnet to the ferromagnetic material 34 retains the vehicle 32 on the fixed ramp 38, the vehicle 32 may travel in a substantially vertical orientation along the fixed ramp 38 and the pivoting ramp 40 without deviating from the desired vehicle path.

Figure 8:
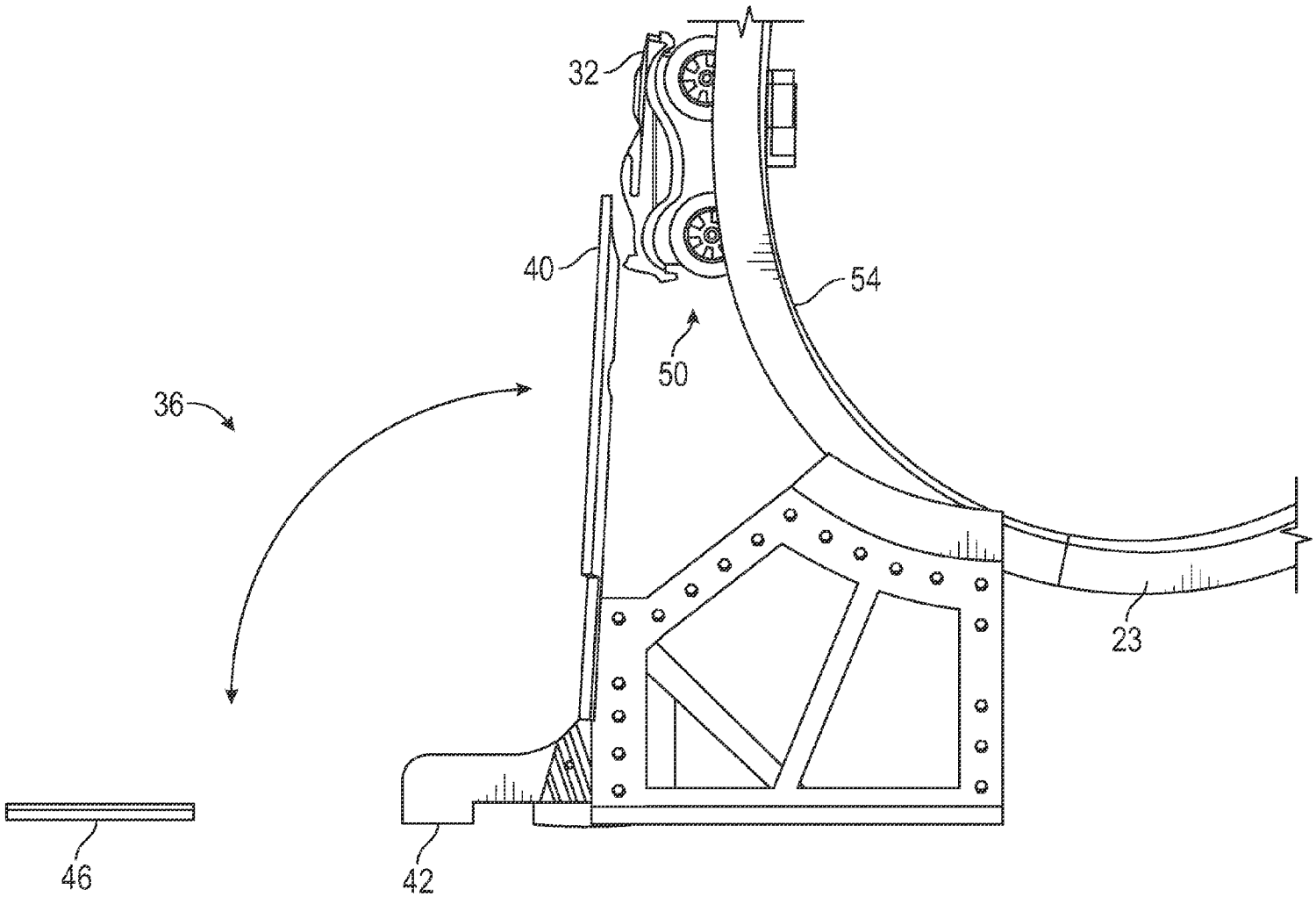
FIG. 8 is a side view of the entrance portion of the toy track set of FIG. 1.
Figure 9:
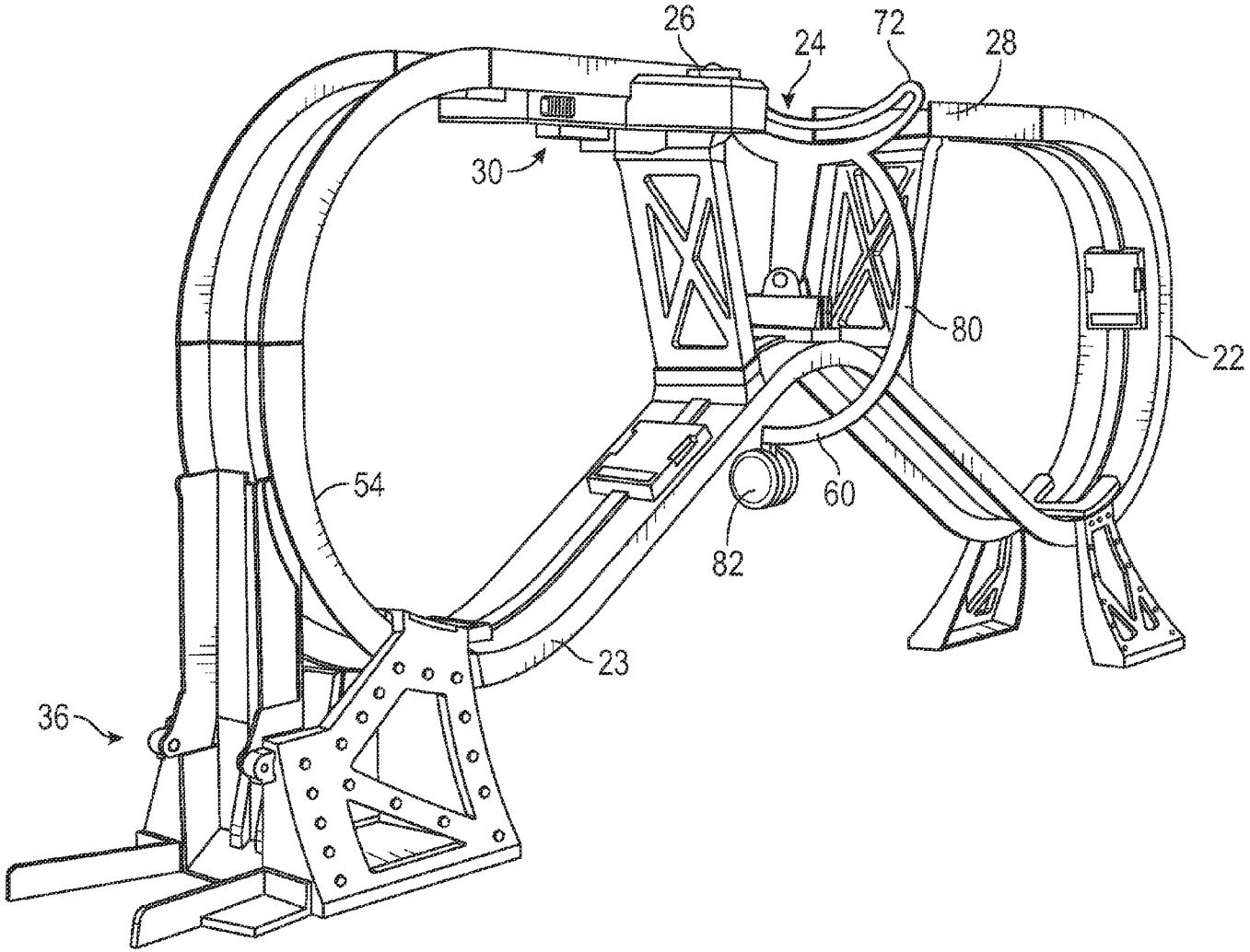
FIG. 9 is a perspective view of the toy track set of FIG. 1 with another embodiment of a pendulum arm.
Figure 10:
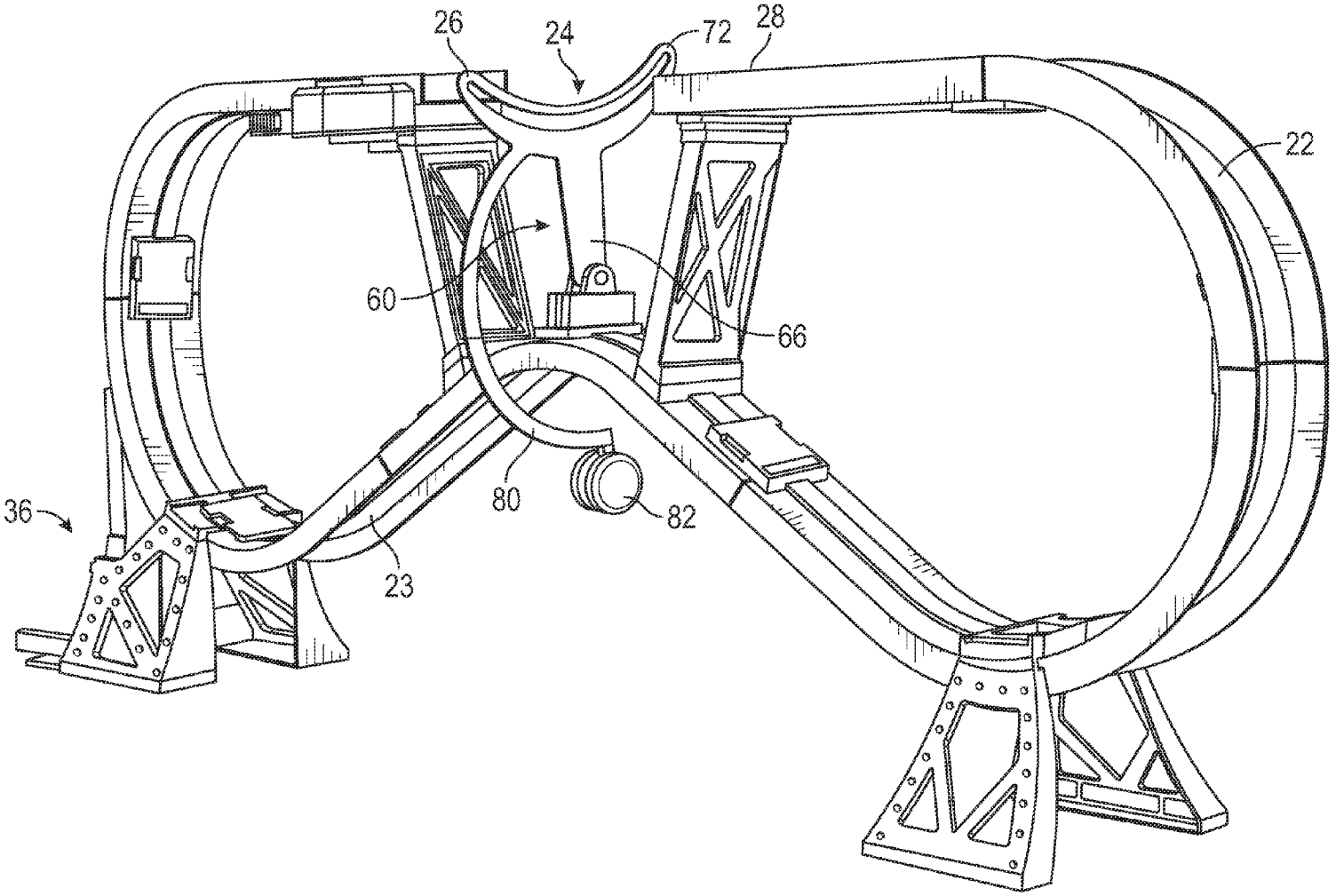
FIG. 10 is another perspective view of the toy track set of FIG. 9.
Figure 11:
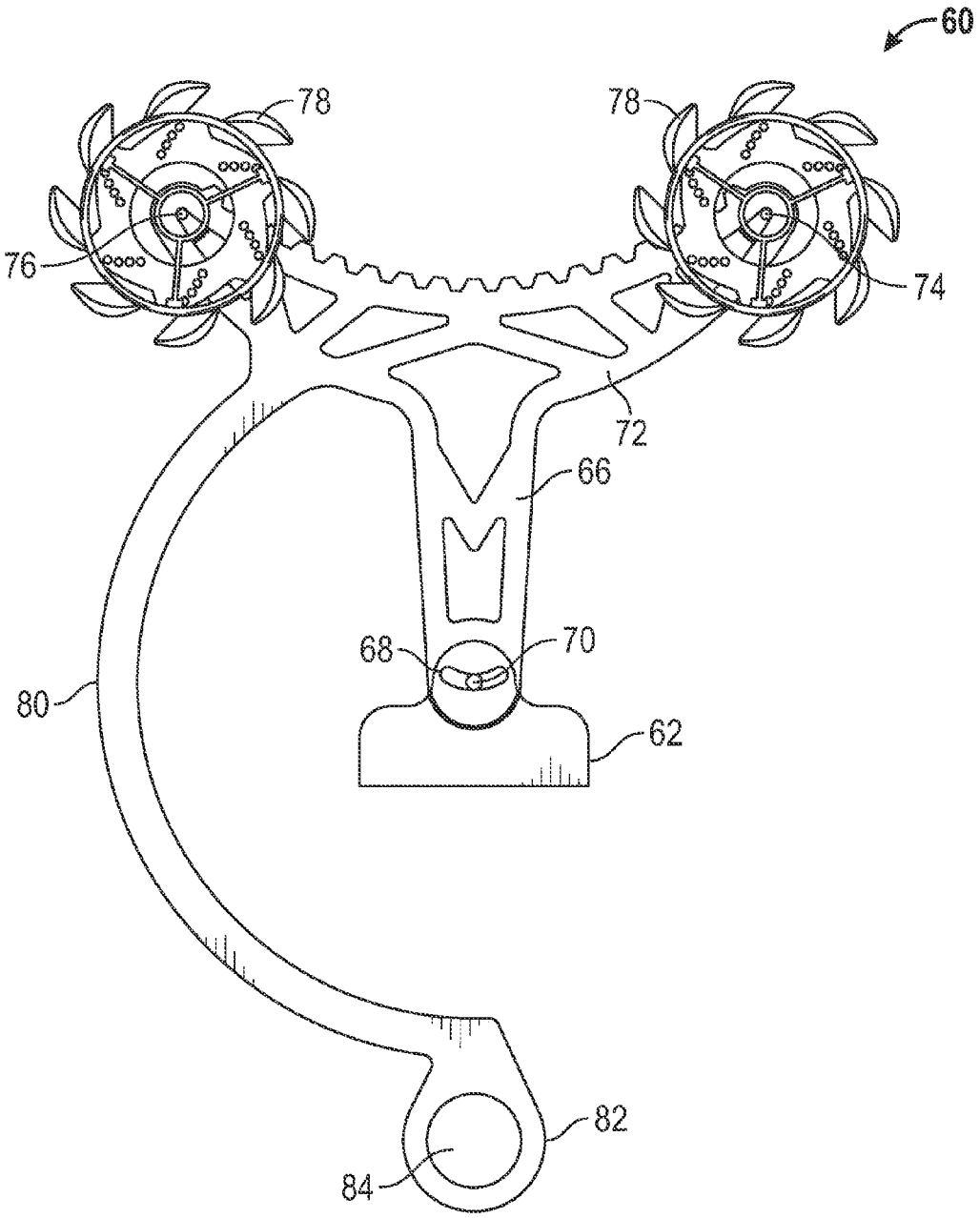
FIG. 11 is a side view of an embodiment of the pendulum arm of FIG. 9.
Figure 12:
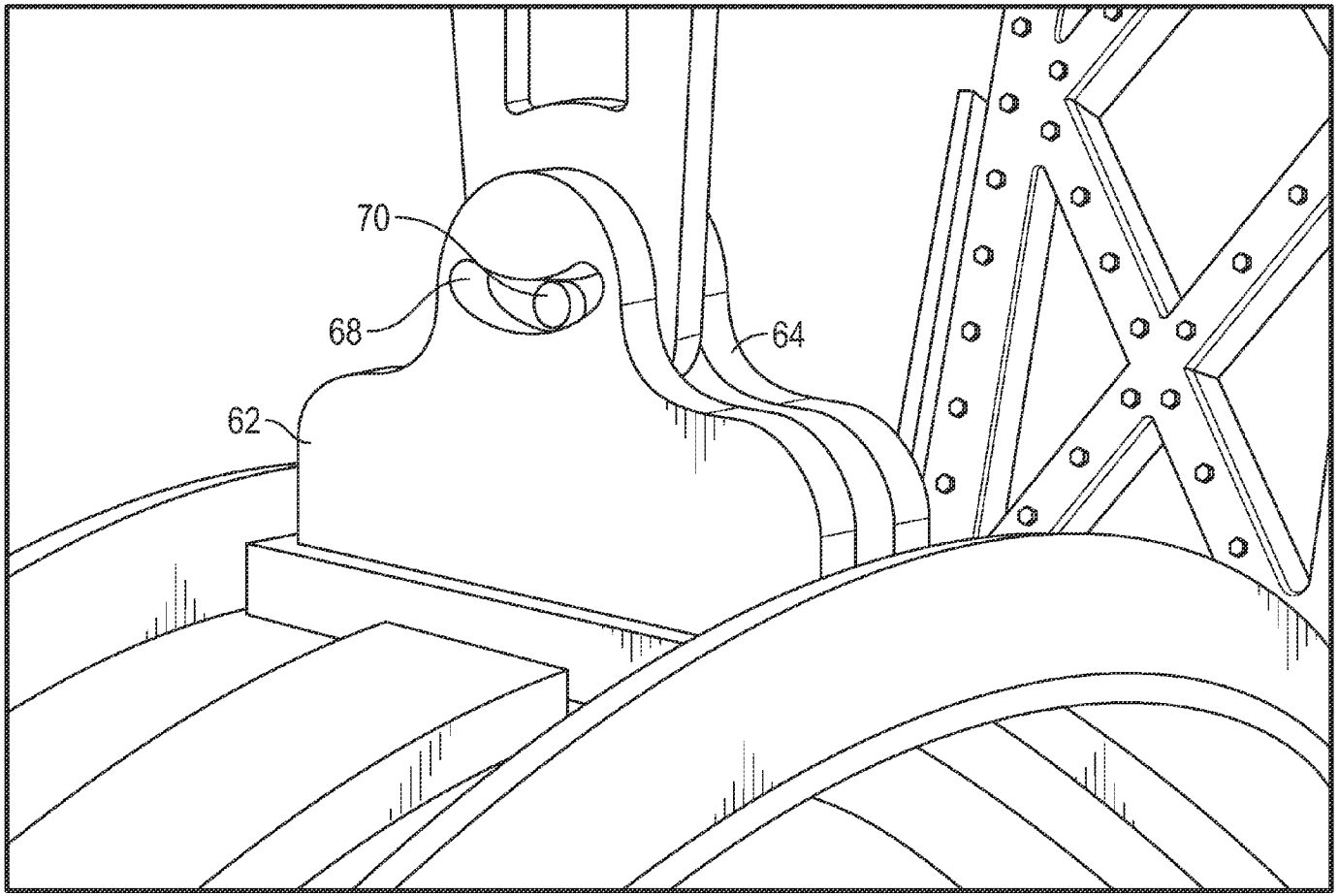
FIG. 12 is a perspective view of an embodiment of the pendulum stand for the pendulum arm of FIG. 9.
Figure 13:
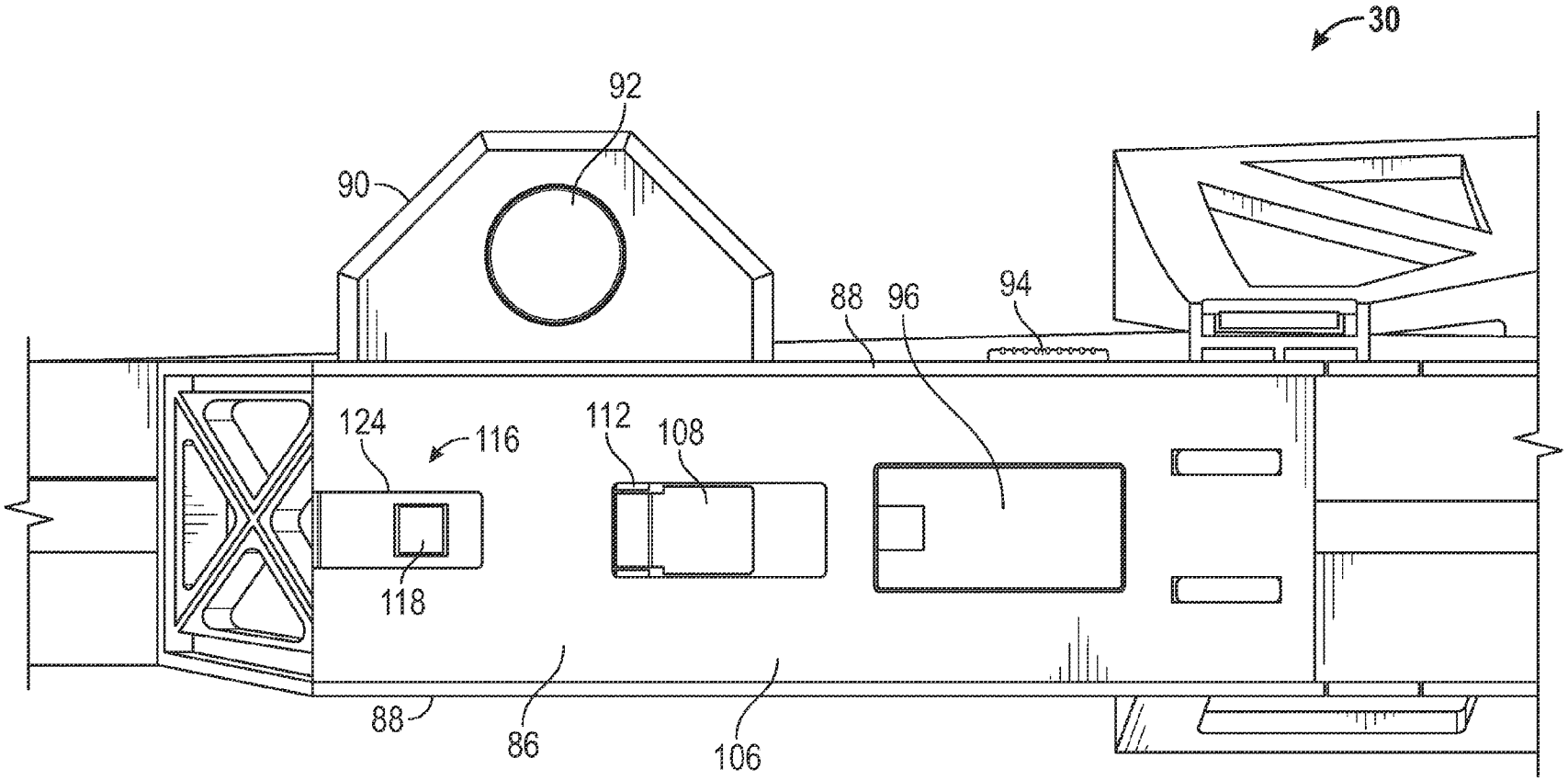
FIG. 13 is a top view of an embodiment of a catapult mechanism for use with the toy track set of FIG. 1.
Figure 14:
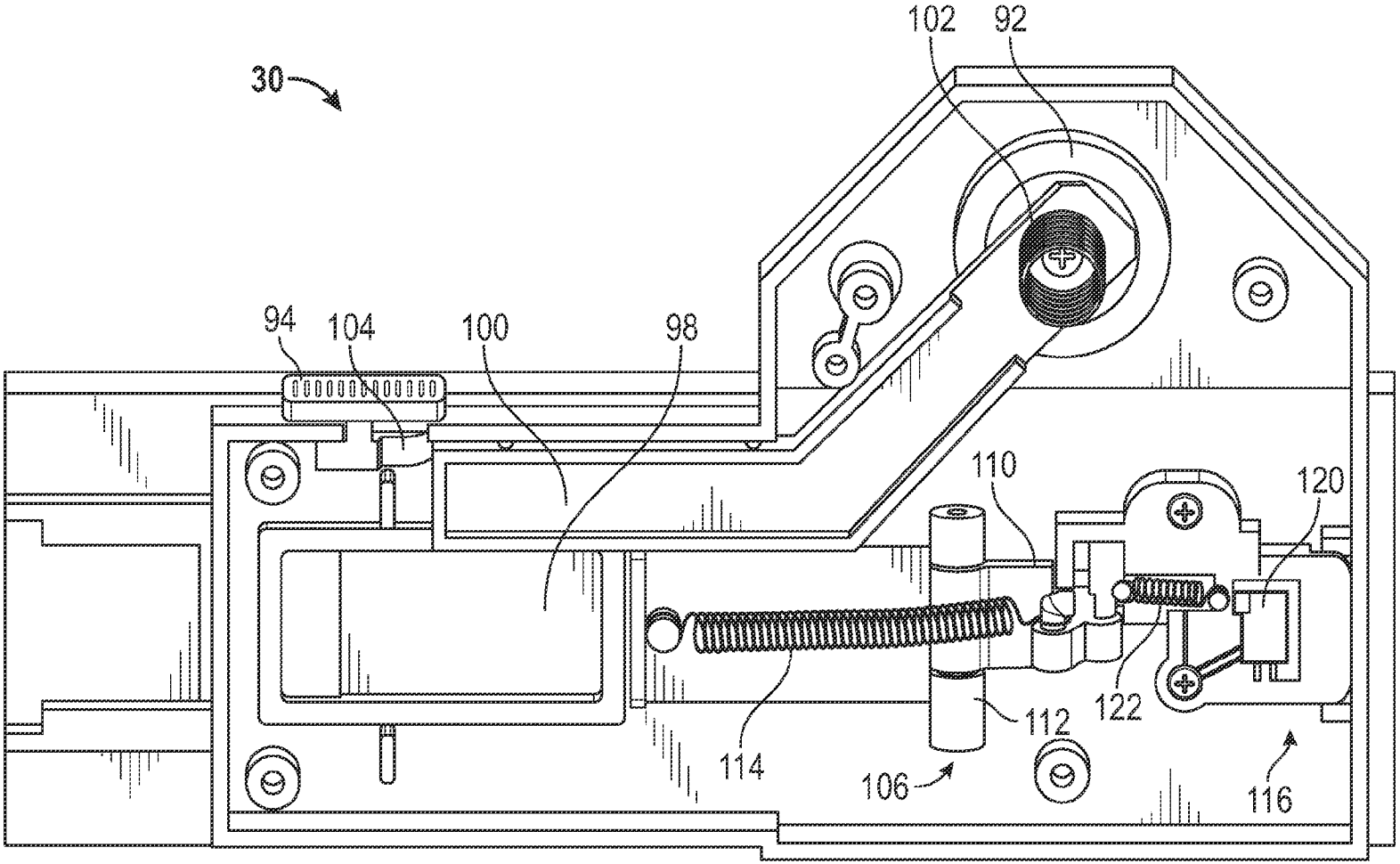
FIG. 14 is a bottom view of the catapult mechanism of FIG. 13 in a activated position with a cover removed.
Figure 15:
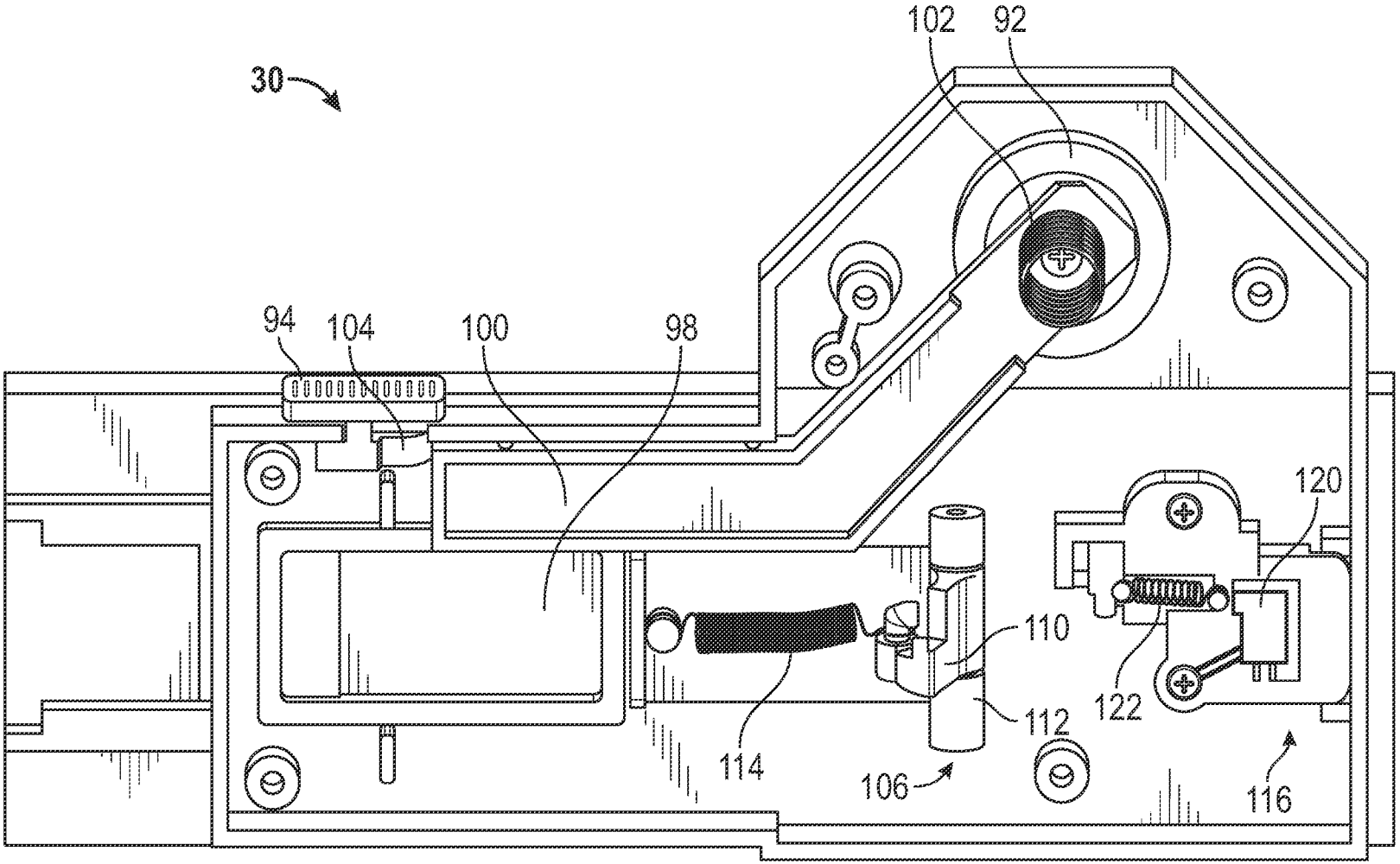
FIG. 15 is a bottom view of the catapult mechanism of FIG. 13 in a discharged position with a cover removed.
Figure 16:
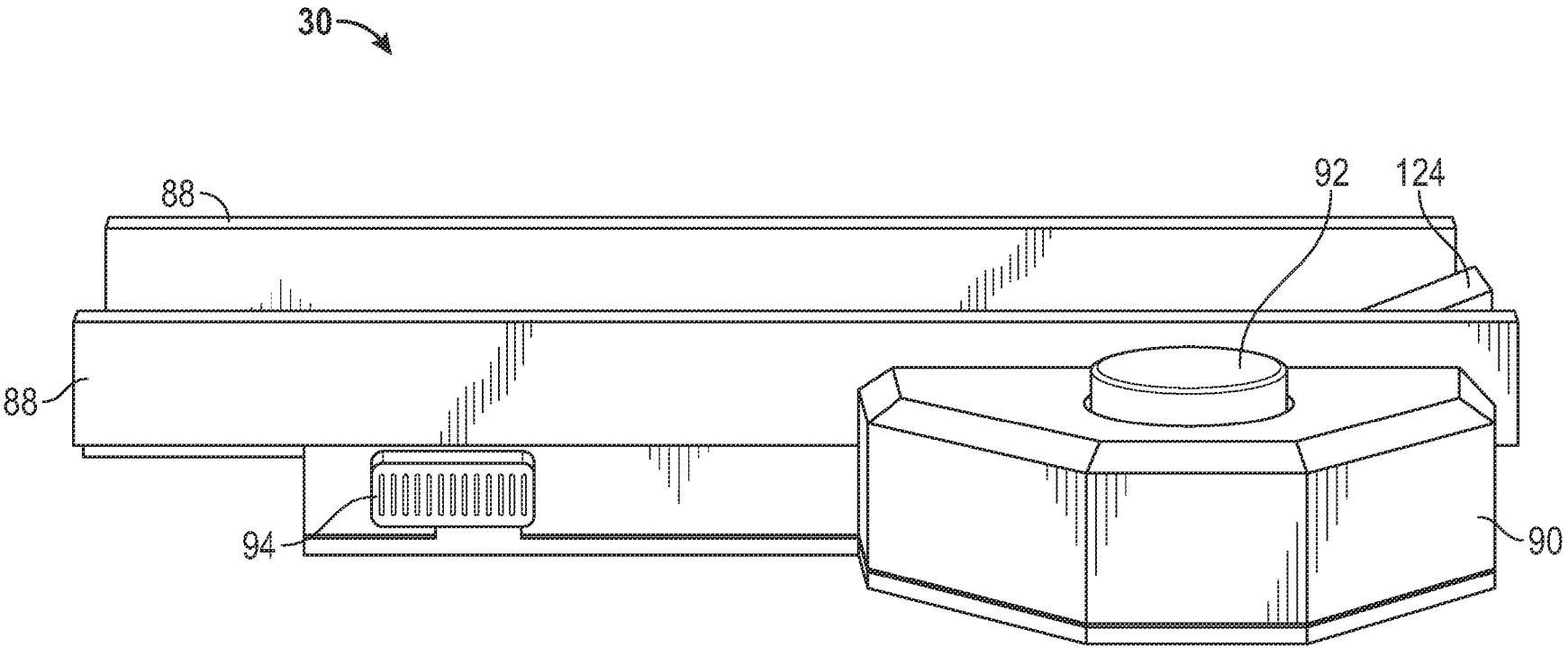
FIG. 16 is a side view of the catapult mechanism of FIG. 13.
Figure 17:
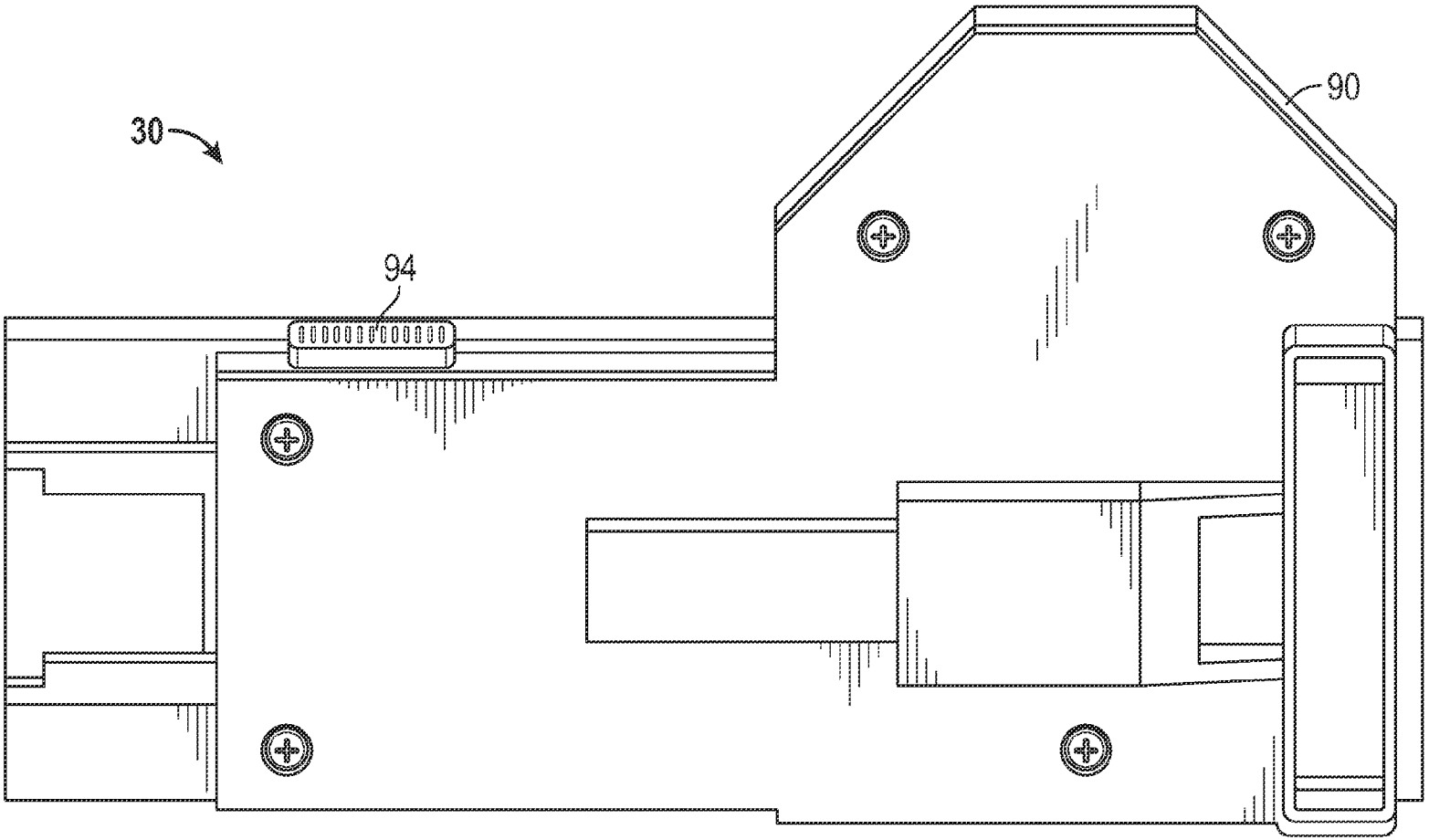
FIG. 17 is a bottom view of the catapult mechanism of FIG. 13.

Once the vehicle 32 is on the track 22, the vehicle 32 follows the vehicle path across the gap 24 and along the inverted track portion 23. At the end 54 of the inverted track portion 23, the vehicle 32 will approach and contact a side 56 of pivoting ramp 40. Upon contact of the vehicle 32 with the side 56, the pivoting ramp 40 will rotate towards the second position away from the track 22. As the pivoting ramp 40 moves, a gap 58 is formed to allow the vehicle 32 to continue along the track 22 uninterrupted (FIG. 8). In one embodiment, the pivot members 48 do not include a biasing spring and the user will reset the pivoting ramp 40 to the first position.

Referring now to FIGS. 1-3 and FIGS. 9-12, an embodiment is shown having a pendulum device 60. The pendulum device 60 provides a movable obstacle within the gap 24. As will discussed in more detail below, the combination of the pendulum device 60 with the catapult mechanism 30 provides a skill and timing aspect to the users play with the toy track set 20. The pendulum device 60 includes a base 62 that is coupled to the inverted track portion 23 opposite the gap 24. The base 62 may include a pivot 64 that allows a pendulum arm 66 to rotate relative to the base 62. In one embodiment, the base 62 may include a slot 68 that cooperates with a shaft 70 mounted in the pendulum arm 66 to limit the amount of rotation of the pendulum device 60. In another embodiment, the shaft 70 may form the axis of rotation.

The pendulum arm 66 extends away from the base 62 towards the gap 24. At an opposite end from the base 62 is a transverse arm 72. The transverse arm 72 has a first end 74 and an opposing second end 76. In the exemplary embodiment, the ends 74, 76 are disposed substantially equidistant from the pendulum arm 66 to provide a balanced assembly. Coupled to the ends 74, 76 are one or more obstacle devices 78. The obstacle devices 78 may be in the form of a construction sign (FIG. 1), a saw blade (FIGS. 2-3 and 11) or any other desirable simulated object that may enhance the imaginative play of the user. In one embodiment, the pendulum arm 66 may be fixed and the transverse arm 72 rotates relative to the pendulum arm 66. During play, as the pendulum device 60 rotates, the obstacle devices 78 rotate into and out of the vehicle path that extends through the gap 24. It should be appreciated that as the vehicle 32 traverses the gap 24, the vehicle 32 may impact the device 78 causing the vehicle 32 to leave the vehicle path.

Extending from one side of the transverse arm 72 is a counter weight arm 80. The counter weight arm 80 extends about the inverted track portion 23 and has a counter weight portion 82. In one embodiment, the counter weight portion 82 may be a fixed counter weight, such as 17 grams for example. In another embodiment, the counter weight portion 82 may include an opening 84 that allows the user to change the size of the counter weight. It should be appreciated that by changing the size of the counter weight, the speed at which the pendulum device 60 rotates may be changed.

To assist the toy vehicle 32 in traversing the gap 24, a jumping or catapult mechanism 30 may be provided. In one embodiment shown in FIGS. 13-17, the catapult mechanism 30 may include a track portion 86 having side walls 88. On one side of the track portion 86 is a button housing 90 having a release button 92. Adjacent the housing 90 is a switch 94. As will be discussed in more detail below, the switch 94 allows the user to select between continuous jumping and a stop-hold-launch mode of operation.

Arranged on the track portion 86 adjacent the switch 94, is an adjustable platform 96. The platform 96 is movable between a first position substantially level with the plane of the track portion 86 and a second or raised position. When in the raised position, the platform 96 elevates the vehicle 32 above the track portion 86 to hold the vehicle 32 in place until the user depresses the release button 92. The platform 96 includes a lower member 98 (FIG. 14) disposed below the track portion 86. An arm 100 extends from the lower member to engage the release button 92. A spring 102 biases the arm 100 and the platform 96 towards the elevated position. In the event the user desires automatic or continuous jumping of the vehicle 32, the user slides the switch 94 from a first position to a second position. As the switch 94 is moved, a projection 104 on the switch 94 engages the arm 100 to move and hold the arm 100 and the platform 96 in the first position. With the switch 94 in the second position, the platform 96 does not interrupt the motion of the vehicle 32.

Adjacent the platform 96 is a catapult 106. The catapult 106 includes a first arm 108 and a second arm 110 that are coupled to the track portion 86 by a pivot 112. The arms 108, 110 are movable between an activated or first position, wherein the first arm 108 is substantially level with the plane of the track portion 96 and a discharged or second position. The second arm is coupled to a spring 114. The catapult 106 is held in the activated position by a release mechanism 116. The release mechanism 116 is movable between a first position and a second position and includes a trigger 118 that is disposed within the vehicle path. An arm member 120 extends below the track portion and couples to a spring 122. The release mechanism includes a pivot (not shown) that is arranged to allow the spring 122 to return the trigger 118 to the first position in the vehicle pathway. The arm member 120 engages the second arm 110 to retain the catapult 106 in the first position (e.g. with the first arm 108 level with the track portion 86). In one embodiment, a projection 124 extends from the track portion 86 adjacent the trigger 118. The projection 124 forms a ramp that facilitates the vehicle traversing the gap 24.

During operation, the user selects between an automatic or continuous mode and a push-to-release mode. When in the continuous mode, the user slides the switch 94 causing the projection 104 to engage the arm 100 and move the platform 96 to a position wherein the platform 96 does not interfere with the movement of the vehicle 32. If the user wants to control when the vehicle 32 will traverse the gap 24, the switch 24 is moved to the first position where the platform 96 is elevated. When in the elevated position, the vehicle 32 will move onto the platform 96 as the vehicle moves along the track 22. As the vehicle 32 moves onto the platform 96, the wheels of the vehicle will lose contact with the track portion 86 causing the vehicle 32 to stop.

After selecting the mode of operation, the user then rotates the catapult 106 by depressing the first arm 108. As the catapult 106 rotates, the second arm 110 engages the arm member 120 of the release mechanism 116. Under the biasing force of spring 114 and spring 122, the second arm 110 and the arm member 120 cooperate to hold the catapult 106 in the activated position. With the catapult 116 activated, the catapult mechanism 30 is ready to be used. When the vehicle 32 contacts the trigger 118, the release mechanism 116 moves causing the arm member 120 to disengage from the second arm 110. The releasing of the second arm 110 allows the spring 114 to rapidly rotate the first arm 108 into contact with the vehicle 32. The first arm 108 imparts a sufficient force on the vehicle 32 to allow the vehicle 32 to traverse the gap 24. Once across the gap 24, the vehicle 32 proceeds along track 22.

In embodiments having the pendulum device 60, the user may rotate and release the pendulum device 60 causing the obstacle devices 78 to rotate into and out of the vehicle path. With the pendulum device 60 operating, the user may select the push-to-release mode of operation. In this mode, the vehicle 32 is stopped by the platform 96. The user may then wait until the obstacle devices 78 are in a desired position and push the release button 92. The depressing of the release button 92 moves the platform allowing the vehicle 32 to contact the track portion 86 and proceed forward. When the vehicle 32 contacts the trigger 118, the catapult 106 is released propelling the vehicle 32 across the gap 24 as described above.

Figure 18:
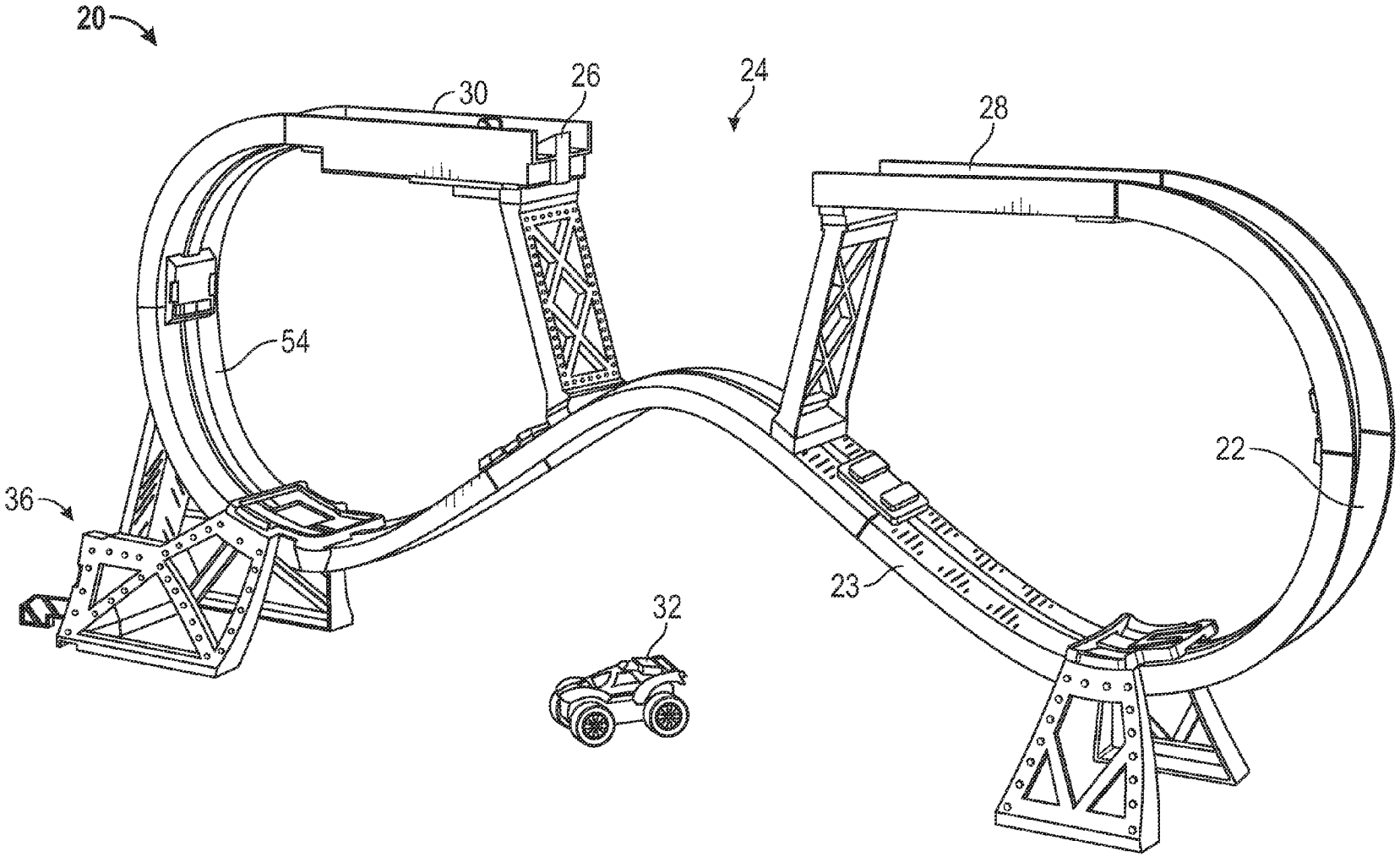
FIG. 18 is a perspective view of another toy track set in accordance with an embodiment of the invention.

Referring now to FIG. 18, another embodiment is shown having a toy track set 20 without the pendulum device to act as an obstacle. The embodiment of FIG. 18 otherwise operates and is configured the same as the toy track sets 20 described herein above.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are not intended to be within the scope of the claims, or if they include equivalent structural elements with insubstantial differences from the literal languages of the claims.

The invention claimed is:

1. A toy track set comprising:

a vehicle path defined by a track and a gap disposed between a first end and a second end of the track;

a catapult mechanism disposed within the vehicle path adjacent the first end, the catapult mechanism comprising:

a platform member movably coupled to the track, the platform member being movable between a first position being substantially level with the track and a second elevated position;

a switch operably coupled to move the platform member from the second position to the first position;

a catapult member having a first arm and a second arm rotationally coupled to the track, the first arm movable between a third position and a fourth position; and, a release mechanism disposed adjacent the first end, the release mechanism having a trigger operably coupled to retain the catapult member in the third position, wherein the release mechanism releases the catapult member in response to a toy vehicle contacting trigger.

2. The toy track set of claim 1 further comprising a release button operably coupled to move the platform member from the second position to the first position.

3. The toy track set of claim 2 further comprising a biasing member coupled to the second arm and disposed to move the first arm from the third position to the fourth position.

4. The toy track set of claim 3 herein the vehicle path includes a first vehicle path and a second vehicle path, the second vehicle path being configured to selectively contact the track, the second vehicle path having a first ramp adjacent a play surface and a second ramp rotationally disposed between the first ramp and the play surface, the second ramp being movable between a first position and a second position.

5. The toy track set of claim 3 herein the vehicle path includes a first vehicle path and a second vehicle path, the second vehicle path being configured to selectively contact the track, the second vehicle path having a first ramp adjacent a play surface and a second ramp rotationally disposed between the first ramp and the play surface, the second ramp being movable between a first position and a second position.

6. The toy track set of claim 5 further comprising a catapult mechanism disposed within the vehicle path adjacent the first end.

7. The toy track set of claim 6 wherein the catapult mechanism comprises:

a platform member movably coupled to the track, the platform member being movable between a first position being substantially level with the track and a second elevated position;

a switch operably coupled to move the platform member from the second position to the first position;

a catapult member having a first arm and a second arm rotationally coupled to the track, the first arm movable between a third position and a fourth position; and, a release mechanism disposed adjacent the first end, the release mechanism having a trigger operably coupled to retain the catapult member in the third position, wherein the release mechanism releases the catapult member in response to a toy vehicle contacting trigger.

8. The toy track set of claim 1 further comprising a movable obstacle at least partially disposed within the gap.

9. The toy track set of claim 8 wherein the movable obstacle comprises:

a base;

a pendulum arm coupled the base;

a transverse arm operably coupled to the pendulum arm, the transverse arm being movable between a first position and second position;

at least one obstacle device coupled to an end of the transverse arm, the at least one obstacle device being positioned in the vehicle path within the gap as the transverse arm moves from the first position to the second position; and, a counter balance operably coupled to the transverse arm.

* * * * *